US005864917A

United States Patent [19]

Landsman

[11] Patent Number: 5,864,917

[45] Date of Patent: Feb. 2, 1999

[54] PRESSURE VANE AND BRACKET FOR UNDERWATER SCRUBBING

[75] Inventor: Allan Landsman, 2020 Nutmeg St., Escondido, Calif. 92026

[73] Assignee: Allan Landsman, Escondido, Calif.

[21] Appl. No.: 58,657

[22] Filed: Apr. 10, 1998

[51] Int. Cl.[6] ..... E04H 4/16; B63B 59/08

[52] U.S. Cl. ..... 15/246; 15/1.7; 114/222

[58] Field of Search ..... 15/1.7, 160, 246; 114/222

[56] References Cited

U.S. PATENT DOCUMENTS

| | | | |
|---|---|---|---|
| 238,624 | 3/1881 | Westberg | 114/222 |
| 2,243,576 | 5/1941 | Otto | 15/160 |
| 3,003,168 | 10/1961 | Shouldice | 15/1.7 |
| 3,402,413 | 9/1968 | Gibellina | 15/1.7 |
| 4,637,087 | 1/1987 | Feinberg | 15/1.7 |
| 4,733,427 | 3/1988 | Conrad | 15/1.7 X |
| 4,742,592 | 5/1988 | Addona, Sr. | 15/1.7 |
| 4,776,053 | 10/1988 | Kiraly | 15/1.7 |
| 4,783,868 | 11/1988 | O'Callaghan | 15/1.7 |
| 4,909,173 | 3/1990 | Strong | 114/222 |
| 4,962,558 | 10/1990 | Harrell, Jr. | 15/1.7 |
| 5,487,397 | 1/1996 | Bean | 15/1.7 X |
| 5,539,947 | 7/1996 | Kiraly | 15/1.7 |

FOREIGN PATENT DOCUMENTS

| | | | |
|---|---|---|---|
| 1068216 | 4/1960 | Germany | 15/1.7 |
| 584029 | 1/1947 | United Kingdom | 15/1.7 |
| 2150423 | 7/1985 | United Kingdom | 15/1.7 |

*Primary Examiner*—Mark Spisich

[57] ABSTRACT

An underwater vane (10) attached to a special support bracket (13) which is clamp-mounted on a standard pool broom pole (24). The vane is bent to form two equal planes (11A & 11B) joined together at a central axis. The axis has pivot holes (19) from which the vane is transversely suspended over the pool broom pole. When the pool broom pole is pushed or pulled through the water, the vane is caused to tip by water pressure until one side and then the other touches the pole. The angle formed between the vane and the pole in either direction of motion causes the deflection of the pole and the attached cleaning device toward a surface being scrubbed.

5 Claims, 2 Drawing Sheets

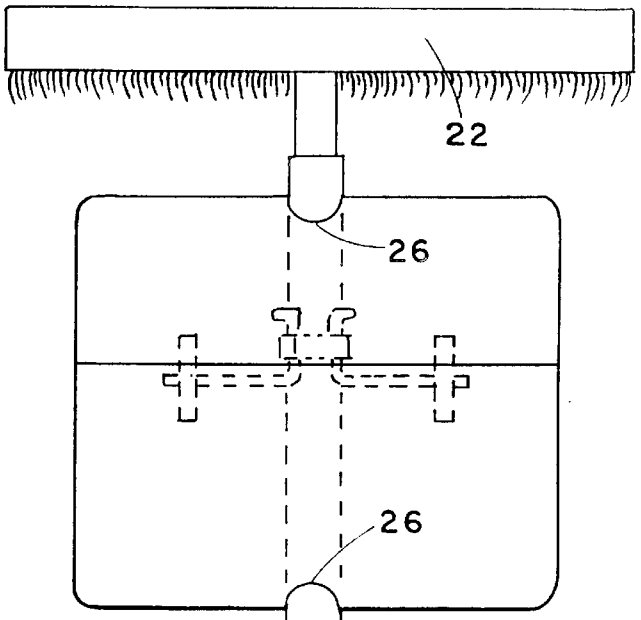
FIG. 1B TOP VIEW
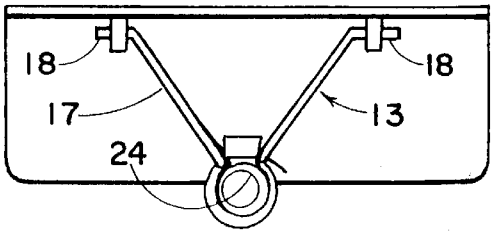
FIG. 1C BACK VIEW
FIGURES 1A-1D
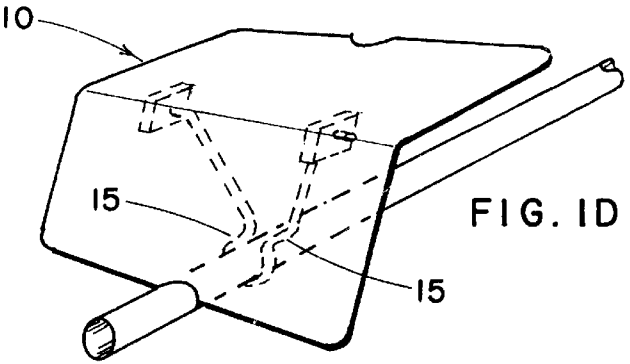
FIG. 1D PERSPECTIVE
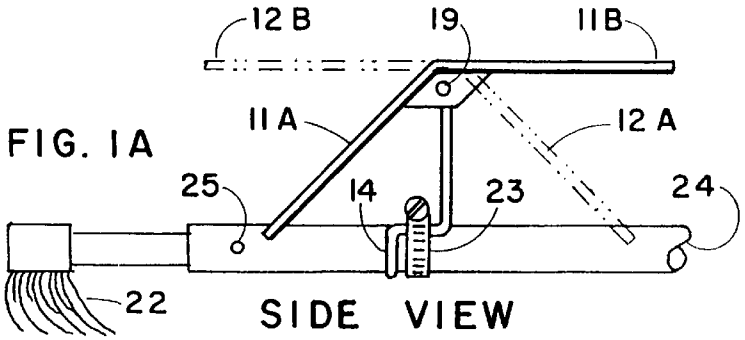
FIG. 1A SIDE VIEW

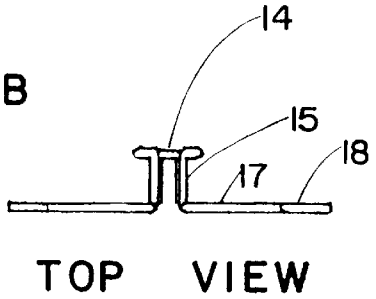
FIG. 2B TOP VIEW
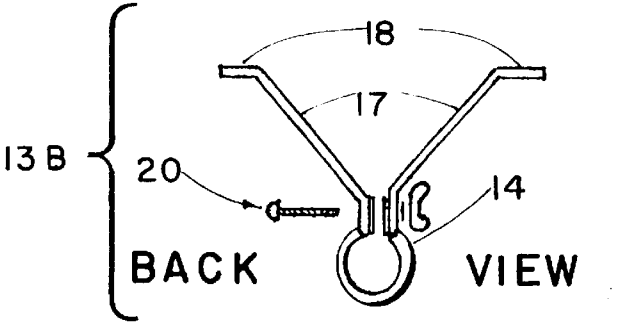
FIG. 2C BACK VIEW
FIGURES 2A - 2D
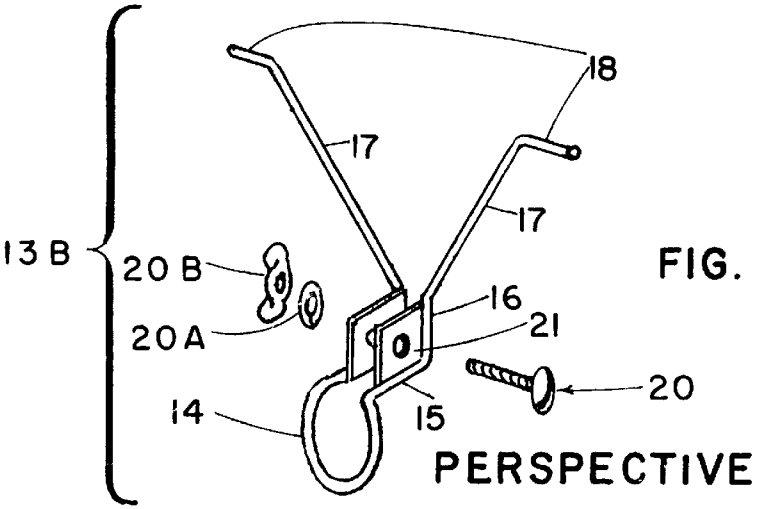
FIG. 2D PERSPECTIVE
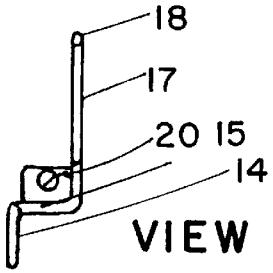
FIG. 2A SIDE VIEW

PRESSURE VANE AND BRACKET FOR UNDERWATER SCRUBBING

FIELD OF INVENTION

This invention relates to the scrubbing of underwater surfaces such as pools and boats by use of a broom on a pole, specifically to a vane and bracket attached to the pole for the purpose of creating side pressure.

GENERAL DISCUSSION OF PRIOR ART

There is a strong tendency for underwater surfaces in pools and on boats to accumulate plant growth (algae). This growth, if allowed to proceed unchecked, becomes a breeding ground for bacteria (in pools) and barnacles (on boats). In pools, the growth is unhealthy, unattractive and slippery. The boat that has any growth has compromised her speed, power and maneuverability not to mention her safety. The secret, is to remove the algae as early as possible, before any build-up begins. To this end, a stiff broom attached to a long pole has become the standard tool of choice.

The problem in using a broom and pole, is the lack of leverage available to the operator. When the broom on the end of the pole is 10–15 feet from the operator it is necessary to maintain proper side-pressure for effective scrubbing. This places a severe strain on the arms and back of the operator.

It is the purpose of the scrubbing to place the algae in suspension in the pool water. Once in suspension, it is then removed from the water by the pool's top and bottom filters. After the algae plant has been scrubbed free of the pool's surface, its roots are left imbedded in the pool surface to be killed by the chlorine content of the pool water.

On boats, the use of special water-amenable paints make it easier for the scrubbing action alone to remove the entire plant.

In both the above scenarios, the algae would be most efficiently removed if scrubbing and the side pressure could be exerted in both the push and pull motion. Maintaining side pressure on an "up" stroke is even more difficult than the "down" stroke. On the "down" stroke at least you have gravity helping you.

DESCRIPTION OF PRIOR ART

| Name | U.S. Pat. No. | Date |
|---|---|---|
| Westberg | 238,624 | 03/1881 |
| Otto | 2,243,576 | 05/1941 |
| Shouldice | 3,003,168 | 10/1961 |
| Gibellina | 3,402,413 | 09/1968 |
| Feinberg | 4,637,087 | 01/1987 |
| Addona, Sr. | 4,742,592 | 09/1987 |
| Strong | 4,909,173 | 03/1990 |

There have been several attempts made to produce a device to aid in creating the needed side-pressure on the brooms or vacuum head. Each of them has one or more of the following disadvantages.

1. Prior art does not allow you to use the broom and pole you may already own, thereby increasing cost. (Shouldice U.S. Pat. No. 3,003,168, Oct. 10, 1961).

2. Prior art is designed to assist in applying side-pressure in only one direction of use (pushing). This results in a loss of time and effort since no scrubbing or less effective scrubbing takes place when the broom is pulled back. In one instance (Feinberg U.S. Pat. No. 4,637,087, Jan. 20, 1987) the prior art deliberately and quite mistakenly tries to avoid brushing in the pull motion. Also in Addona, Sr. U.S. Pat. No. 4,742,592, Dec. 5, 1986, their stated purpose in claim 1.a reads, " . . . for forcing said tool away from said surface in a second, or retrieval, motion." This feature, one-way use, leaves half the operator's labor ineffective since no scrubbing is done in the retrieval motion.

3. Prior art is complex, comprised of very numerous, intricately machined parts, thereby increasing costs.

4. Prior art has methods of attaching and removing the "hydrofoil" device from the broom pole which are time-consuming and difficult. This creates a need for separate poles for other, commonly used attachments such as nets, thereby increasing cost.

5. Prior art handicaps the operator by its weight and unnecessary surface area exposed to underwater motion. Since the device is attached to the furthest end of the pole, near the broom, any additional weight or increased water resistance is greatly amplified and creates undue strain on the operator. Prior art also includes surfaces which create water resistance when the broom is moved sideways which requires unnecessary effort.

6. Prior art has surfaces exposed to the flow of water during the push-pull operation that do not add to the desired side-pressure. This increases water resistance and consequently increases the effort required with no improvement in the scrubbing action.

7. Prior art, in all cases, is composed of numerous operating parts which increase the chance of failure.

8. Prior art has utilized a flat plane hydrofoil which has several design problems. When the foil is fixed it creates "drag" when the broom pole is retrieved and a wild move away from the surface being scrubbed. When the foil is pivoted, the force of the water is exerted on both sides of the pivot which creates foil control problems. Both the above configurations require additional structures to compensate.

OBJECTS AND ADVANTAGES

The purpose of this invention, henceforth, to be referred to as "Scrub-Marine", is to provide the operator with the necessary side-pressure on the broom, leaving him to supply only a straight line push or pull motion. By eliminating the need to manually apply side-pressure while pushing or pulling, the "Scrub-Marine" is designed to reduce the strain on the operator and also speed the cleaning operation, by scrubbing in both directions of motion.

1. The "Scrub-Marine" Vane and Bracket are designed to be added on to the standard 1¼" pole commonly used with pool brooms. Since virtually all homes with pools already have a pool broom and pole, this saves the consumer money.

2. "Scrub-Marine" helps apply side pressure equally well in both directions (pushing and pulling). Side pressure is exerted in the same proportion to the force of the stroke in either direction. Two-way assistance means faster scrubbing with less effort.

3. "Scrub-Marine" has only three basic parts: a Vane, a Bracket and a clamping device. (2 Embodiments) Simplicity of design greatly reduce the cost over prior art.

4. "Scrub-Marine" may be easily clamped on or removed from the pole. This frees the pole for other uses such as the net whose use would be restricted by the presence of any hydrofoil. Ease of attachment or removal makes the need to purchase extra poles unnecessary. This saves the consumer time and expense.

The clamp-on method of attachment also avoids the need to drill bolt holes. Over time this would cause wear and weaken the aluminum pole. Clamp-on also means easier and more accurate installation.

5. "Scrub-Marine" weighs less than 18 oz. The sideways motion is resisted only by the thin edge of the vane and the small size of the wire bracket.

6. "Scrub-Marine" has virtually no additional surfaces exposed to the flow of water while pushing or pulling except for the vane which is directly used for applying the desired side pressure.

7. "Scrub-Marine" has only one moving part (the vane) which by its simplicity and other design features assures a virtually flawless operation.

8. "Scrub-Marine" uses a bent vane design as opposed to the flat hydrofoil used in prior art. This feature of a bent vane requires a rotation of only 45° to switch between the push and pull direction. Since the prior art requires a rotation of 90° to accomplish the same purpose, "Scrub-Marine" works in half the distance and twice the speed.

The bent vane of "Scrub-Marine" is not only quicker in response to a change of direction, but more efficient because it does not require additional structures to stop the rotation of the vane 10, but instead uses the pole 24 itself as the limiting agent. The vane has virtually no projection above its pivot point 19, but instead is bent into a trailing plane 11B. The trailing plane offers virtually no water resistance to conflict with that on the pressure plane 11A. This makes possible a rotating vane with no need for additional compensating structures.

This unobvious feature (the bent plane) is also what allows the vane to be reversible. When water pressure is reversed on the pressure plane by a change of direction (push to pull) the pressure plane becomes the agent for lifting itself off the pole 45° into a trailing plane position. The former trailing plane is simultaneously forced down onto the pole into the new pressure plane position. (see FIG. 1A).

9. "Scrub-Marine" can be used to scrub in any direction underwater. It can scrub up, down, or sideways. It applies side-pressure in the direction opposite to the side on which the "Scrub-Marine" is mounted. (FIG. 1A). A simple rotation of the pole in the operator's hand adjusts the pressure to the direction desired.

Further, objects and advantages of my invention will become apparent from a consideration of the drawings and ensuing description.

DRAWING FIGURES

FIGS. 1A–1D—Embodiment I

FIG. 1A—Side View of the "Scrub-Marine" and its relation to the broom and pole.

FIG. 1B—Top View—of the "Scrub-Marine" and its relation to the broom and pole.

FIG. 1C—Back View—of the "Scrub-Marine" and its relation to the broom pole.

FIG. 1D—Perspective View—of the "Scrub-Marine" and its relation to the broom pole.

FIGS. 2A–2D Embodiment II

The drawings on FIGS. 2A–2D represent a second embodiment of the bracket in FIGS. 1A–1D. The main difference is the addition of the riser portions, 16, and bolt plates, 21. These make possible the use of a bolt and wing nut, 20 thereby eliminating the hose clamp, 23, and the need for a screwdriver to assemble and disassemble.

FIG. 2A—Side View—of the Bracket, 13B

FIG. 2B—Top View—of the Bracket, 13B

FIG. 2C—Back View—of the Bracket, 13B

FIG. 2D—Perspective View—of the Bracket, 13B

REFERENCE NUMERALS IN DRAWINGS

The following reference numerals are used for FIGS. 1A–1D (Embod. I.) and FIGS. 2A–2D (Embod. II).

| | | | |
|---|---|---|---|
| 10 | Vane - complete | 18 | Pivot Pin (2) |
| 11A | Pressure Plane (pushing) | 19 | Pivot Hole (2) |
| 11B | Trailing Plane (pushing) | 20 | Bolt assembly (complete) |
| 12A | Pressure Plane (pulling) | 20A | lock washer |
| 12B | Trailing Plane (pulling) | 20B | wing nut |
| 13 | Bracket (complete) Embod. I includes 14, 15, 17 and 18. | 21 | Bolt Plate (2) (welded) (Embod. II only) |
| 13B | Bracket (complete) Embod. II includes all of part 13 plus parts 16, 20 and 21. | 22 | Broom (C.O.)* |
| 14 | Locking Ring | 23 | Hose Clamp (Embod. I only) |
| 15 | Base (2) | 24 | Broom Pole (C.O.)* |
| 16 | Riser (2) (Embod. II only) | 25 | Spring Pin (C.O.)* |
| 17 | Diagonal Arm (2) | 26 | Pole Cutout (2) |

*C.O. — Customer's own

SUMMARY

The present invention is an underwater vane designed to be mounted by a special bracket on the standard pool-broom pole. This vane, when properly mounted, changes the push-pull forces supplied by the operator, by deflecting it sideways against a surface. This sideways deflection improves the desired scrubbing action and relieves the strain on the operator to accomplish the same effect manually.

The vane automatically rotates approximately 45° when the pole's direction of motion is changed from push to pull. The same degree of side-pressure is exerted in either direction. (FIG. 1A).

The vane and bracket are easily installed or removed from the broom pole. This feature is accomplished by the special clamp-on action of the holding bracket. This is shown in Embod. I and Embod. II.

Other obvious aspects of design, along with advantages in use and production will become more clearly outlined in the following description and claims.

DESCRIPTION OF INVENTION

The Vane 10 (see FIGS. 1A–1D) is basically a flat plane that has been bent on a centrally located straight axis to form an angle of approximately 135°. The Vane contains under this central axis two pivot holes 19. (FIG. 1A). The bent vane now forms two planes; the pressure plane 11A and trailing plane 11B as shown in FIG. 1A.

The Vane can be made of heat-formed acrylic sheet (as in the prototype) with two cemented shoulders containing the pivot holes. Or, as I believe, the injection-molding process which might prove more efficient. Injection molding also provides the opportunity of formulating the best plastic for this purpose. The ultimate plastic selected would be rigid enough to withstand the water-pressure applied against it yet soft enough to avoid damaging the aluminum pole it comes in contact with. There is also the somewhat parabolic shape (pole cut-out 26) in the center of each plane. This shape is designed to enlarge the point of contact between the vane and the pole over a longer surface, again, to minimize damage to the pole.

The Bracket 13 (FIGS. 1A–1D) is comprised of several sections each having a separate function. All of the sections are fabricated from a continuous strand of stainless steel wire or other suitable, rust resisting metal approximately 3/16" in diameter. Standard wire-forming machines well known in the art are used. The names and functions of these sections are:

The Locking Ring 14 formed as part of a circle to have an inner diameter approximately 1/16" larger than the outer diameter of the standard 1¼" pool broom pole. The ends of the Ring are stopped short of completing the circle. This gap allows room for the Ring to be tightened. The Ring's slightly oversized diameter allows it to be slipped onto the broom-pole without effort. The metal wire is then turned at a 90° angle along the surface of the pole up toward the handle for a short distance (approx. 1¼") to form:

The Base 15 which is intended as a pressure point for the hose clamp 23 and stabilizing support for the Diagonal Arms 17.

The tightening action of the Hose Clamp is supposed to occur when the two Bases are short of touching to ensure adequate grip of the Ring and Base on the Pole 24. The Base performs the same function of stable support for the Riser 16 (Embod. II). Instead of a Hose Clamp being used for tightening, a Bolt, Lock Washer and Wing Nut 20 are used. The use of Bolt Plates 21 (FIGS. 2A–2D) welded to the Base and Riser make the use of a bolt possible. The Riser is provided to give the Bolt Plate a second side to be welded to. This gives the entire intersection of Base to Riser more strength and front to rear rigidity.

The Diagonal Arms 17 rise to a point just inside the Vane's pivot holes and turn outward. The distance between the points at which they turn outward is gauged to be approximately 50% the width of the Vane. This positions each arm at a point to support the Vane with approximately 25% of the Vane's weight on each side of each arm.

The Pivot Pins 18 are formed as a result of the Diagonal Arms having been bent outward (Embod. I and II). The Pins lie in a straight line that runs perpendicular to the length of the Broom Pole. The height of the Pivot Pins above the pole is gauged to hold the Vane in a position where a Pressure Plane is approximately 45° to the Pole when touching it. The Trailing Plane is consequently approximately parallel to the Pole (FIG. 1A) in this embodiment.

OPERATION OF INVENTION

Installation of the Bracket 10 on the standard pool broom pole 24 (FIGS. 1A–1D) goes as follows:

1. Slide Locking-Ring 14 over the broom end of the pole 24 approximately 7" past the Spring Pin Hole 25 location.
2. Position Hose Clamp 23 over the Base 15—do not tighten yet.
3. Insert Broom 22 in pole making sure the Spring Pins 25 click into place.
4. Sighting from the rear, line up the two Pivot Pins 18 parallel with the line of the Broom, making sure the Broom is on the bottom side and the Pivot Pins are on the top side of the Pole. Then tighten the Hose Clamp.

Installation of the Vane 10 on the Bracket 13 or 13B goes as follows: (see FIGS. 1A–1D)

1. Insert one Pivot Pin 18 into the Pivot Hole 19 on the Vane from the inside.
2. Squeeze the two Diagonal Arms 17 slightly toward each other.
3. Insert second Pivot Pin into its Pivot Hole and release pressure on the arms.

USE—Now that you have installed the "Scrub-Marine" on your pool-broom pole you may proceed to scrub your pool or boat with the following noticeable difference.

Each time you push or pull the broom pole you will notice the broom tends to "hug" the surface you are scrubbing. In fact, the stronger you push, the harder the hug—in both directions! The forces at work are simple:

"Scrub-Marine" has only one working part—the Vane 10. In FIG. 1A you see the Vane in the "push" position. The broom handle is being moved toward the broom. Water pressure hits the outside of Pressure Plane 11A. Pressing down on the Pressure Plane until it meets the Pole 24. This automatically and simultaneously raises Trailing Plane 11B until it lies roughly parallel to the Broom Pole. In this position, water striking the Pressure Plane tends to divert the Plane and Pole (with the Broom attached) toward the Broom and the surface the Broom is scrubbing.

When the direction of motion is reversed (toward the operator) the Pull action, water pressure now changes the Vane position. Now water pressure strikes the under side of the Pressure Plane 11A, lifting it off the pole. As the rotation begins, the old Trailing Plane 11*b* begins to catch water pressure which forces it downward toward the Pole. As this plane begins to catch pressure on its outside surface it becomes the new Pressure Plane 12A. The old Pressure Plane 11A is now lifted to a position roughly parallel to the Pole and becomes the new Trailing Plane 12B. The desired side-pressure is equally and—automatically applied as the operator either pushes or pulls the Broom Pole.

Another feature of the operation which is not easily noticed is the operation of the Diagonal arms 17. As the water pressure forces down on the Vane (toward the Pole) the two Pivot Pins 18 are affected in a similar manner. As they are pressed down, since they are extensions of the Diagonal Arms, they tend to spread apart. As this happens they become more securely imbedded in the Pivot Holes 19. This feature ensures that the two Pivot Pins will not disengage from the Pivot Holes although there are no threaded nuts or even a cotter pin to keep them in place.

CONCLUSIONS, RAMIFICATIONS AND SCOPE OF INVENTION

In addition to the work done in a pool there are other advantages to this "Scrub-Marine". In a pool the operator is generally on "top" of his work. The "Scrub-Marine" can also be used on boat bottoms where the work is above the broom. Because of its unique and powerful ability to push towards the broom, by turning the broom handle in the hand of the operator, the "Scrub-Marine" can also scrub upwards! Sitting in a dinghy, the "Scrub-Marine" can be used to reach out sideways and scrub left or right. If barnacles have built up, the broom can easily be exchanged for a scraper. This would almost eliminate the need for scuba gear in dealing with this problem on boats.

Thus the reader will see that "Scrub-Marine" will provide a highly reliable, lighter, quicker, more versatile and effective tool while at the same time be more economical. For these reasons, I believe that "Scrub-Marine" will be a valuable asset and great assistance to the pool and boat owners.

It might also be mentioned in closing, that there are many professional pool cleaning services that still do their job by laborious arm and back strength. Certainly the people who do the work on a daily basis would welcome the help of a "Scrub-Marine".

I claim:

1. A vane assembly for attachment to a pool broom pole for facilitating underwater operation thereof, said vane assembly comprising:

(a) a plastic vane bent at a central portion thereof so as to define first and second planar rectangular members of equal size, the planar members defining an angle of approximately 135 degrees therebetween, said vane further comprising two spaced pivot holes on an underside thereof and located at the bend in said vane, said pivot holes defining an axis of rotation; and (b) a bracket having a first portion including means for releasably securing the bracket to the broom pole and a second portion including two oppositely directed pivot pins, the pivot pins being adapted to be received in a respective one of the pivot holes of the vane, whereby the vane is allowed to rotate freely as it is affected by changing underwater pressures until one planar member, while the pole is pushed, and the other planar member, when the pole is pulled, tilts downward to touch the pole, the angle formed between the planar members and the pole, when the member is in contact with the pole, being approximately 45 degrees, whereby a scrubbing device attached to the pole is urged toward the surface being cleaned.

2. The vane assembly of claim 1 wherein the planar members of the vane each include a cutout for engagement with the pole.

3. The vane assembly of claim 1 wherein the bracket further comprises a locking ring adapted to be secured around the pole, a pair of risers extending from the locking ring with ends of the risers defining the pivot pins and wherein said means for releasably securing includes a tightening structure for tightening the locking ring against the pole.

4. The vane assembly of claim 3 wherein the tightening structure is a hose clamp.

5. The vane assembly of claim 3 further comprising a pair of bolt plates adjacent the locking ring with each bolt plate associated with a respective one of the risers and wherein the tightening structure comprises a bolt which passes through a hole in each bolt plate and a lock washer and wing nut secured to the bolt.

* * * * *